US009031430B2

(12) United States Patent
Takayanagi

(10) Patent No.: US 9,031,430 B2
(45) Date of Patent: May 12, 2015

(54) IMAGE FORMING APPARATUS

(75) Inventor: Hiroki Takayanagi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 459 days.

(21) Appl. No.: 13/161,841

(22) Filed: Jun. 16, 2011

(65) Prior Publication Data

US 2011/0318033 A1 Dec. 29, 2011

(30) Foreign Application Priority Data

Jun. 29, 2010 (JP) ..... 2010-147530

(51) Int. Cl.

| | |
|---|---|
| ***G03G 15/00*** | (2006.01) |
| ***G03G 15/16*** | (2006.01) |
| ***G03G 15/01*** | (2006.01) |
| ***G03G 21/00*** | (2006.01) |

(52) U.S. Cl.

CPC ..... *G03G 15/0189* (2013.01); *G03G 15/161* (2013.01); *G03G 15/1675* (2013.01); *G03G 21/0005* (2013.01); *G03G 2215/0161* (2013.01); *G03G 2215/1661* (2013.01)

(58) Field of Classification Search

CPC ..... G03G 15/5037
USPC ..... 399/43, 56, 46, 49, 66, 71, 349, 350
See application file for complete search history.

(56) References Cited

U.S. PATENT DOCUMENTS

| | | | | |
|---|---|---|---|---|
| 7,773,902 | B2 | 8/2010 | Takayanagi | |
| 2007/0059027 | A1 | 3/2007 | Ishikawa et al. | |
| 2007/0183801 | A1 * | 8/2007 | Takeuchi et al. | 399/49 |
| 2008/0267648 | A1 | 10/2008 | Takayanagi | |
| 2009/0010668 | A1 * | 1/2009 | Takeuchi | 399/66 |
| 2009/0324278 | A1 * | 12/2009 | Tomura et al. | 399/101 |
| 2010/0196026 | A1 * | 8/2010 | Shida | 399/44 |

FOREIGN PATENT DOCUMENTS

| | | |
|---|---|---|
| JP | 2007-3634 A | 1/2007 |
| JP | 2007-127963 A | 5/2007 |

OTHER PUBLICATIONS

Chinese Office Action dated Jul. 25, 2013, in related Chinese Patent Application No. 201110179743.6 (with English translation).

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus includes an image bearing member, an image forming device for forming a toner image on the image bearing member, a recording material, a transfer device for transferring the toner image from the image bearing member to the recording material, a transfer belt for carrying the recording material, a first cleaning member, a second cleaning member, and a voltage control device. When continuously forming toner images on sheets of the recording material, a detection toner image is formed on the image bearing member between images to be formed on sheets of the recording material. The first cleaning member cleans the image bearing member. The second cleaning member cleans the transfer belt. The voltage control device controls the voltage applied to the transfer device so that the number of operations to clean the detection toner image is higher for the second cleaning member than the first cleaning member.

5 Claims, 8 Drawing Sheets

| ITB 8 | IMPROPER CLEANING | | |
|---|---|---|---|
| FRQNCY | 150mm | 483mm | |
| 100% | 27 SHEETS | 21 SHEETS | ← EVERY PATCH |
| 75% | 30 SHEETS | 24 SHEETS | ← 3/4 |
| 50% | ○ | ○ | ← 1/2 |
| 25% | ○ | ○ | ← 1/4 |
| 0% | 9 SHEETS | 18 SHEETS | ← NO PATCH |
| ETB 19 | IMPROPER CLEANING | | |
|---|---|---|---|
| FRQNCY | 150mm | 483mm | |
| 100% | 27 SHEETS | 27 SHEETS | ← EVERY PATCH |
| 75% | ○ | ○ | ← 3/4 |
| 50% | ○ | ○ | ← 1/2 |
| 25% | 18 SHEETS | 12 SHEETS | ← 1/4 |
| 0% | 9 SHEETS | 6 SHEETS | ← NO PATCH |
FIG.6
FIG. 9A
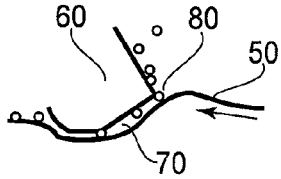
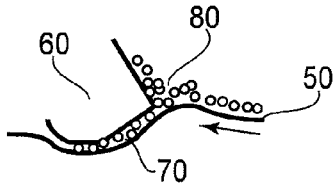
FIG. 9B
FIG. 9C
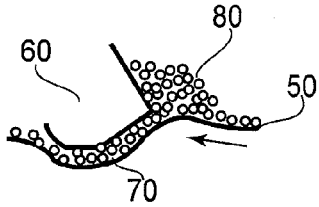

IMAGE FORMING APPARATUS

FIELD OF THE INVENTION AND RELATED ART

The present invention relates to an image forming apparatus, such as a copying machine or a printer, of an intermediary transfer type using electrophotographic technology or electrostatic recording technology.

Japanese Laid-Open Patent Application (JP-A) 2007-003634 discloses a four color-based full-color electrophotographic image forming apparatus of the intermediary transfer type. This image forming apparatus includes four electrophotographic image forming portions for forming toner images (developer images) of four colors of yellow, magenta, cyan and black. Then, the four color toner images formed at the four image forming portions, respectively, are successively primary-transferred superposedly onto an intermediary transfer belt (intermediary transfer member), so that unfixed toner images for full color are synthetically formed on the intermediary transfer belt. Further, the image forming apparatus includes a secondary transfer belt (secondary transfer member) which is rotated and forms a secondary transfer nip, together with the intermediary transfer belt, in which a recording material is to be nip-conveyed. Then, during a period in which a recording material is guided into the secondary transfer nip and is nip-conveyed in the secondary transfer nip, a secondary transfer voltage is applied from a secondary transfer voltage applying means, so that the unfixed toner images for full color are collectively secondary-transferred from the intermediary transfer belt onto the recording material. The recording material which has passed through the secondary transfer nip is separated from a secondary transfer belt and is conveyed and guided into a fixing portion, where the toner images are subjected to heat-pressing fixing step. The intermediary transfer belt is cleaned by a cleaning device by removing residual deposited matter, such as secondary transfer residual toner and then is repetitively subjected to image formation. The secondary transfer belt is also cleaned by the cleaning device by removing the deposited matter, such as the deposited toner. As the cleaning device, the cleaning device using an elastic blade (cleaning blade) is used. This cleaning device removes the residual deposited matter, such as the toner or paper dust by bringing a plate-like rubber blade into contact to the belt counterdirectionally with a belt rotational direction and by rubbing the belt with the blade.

Further, as described in JP-A 2007-127963, an image forming apparatus in which a patch image for controlling image density is formed in a sheet interval with the developer and then is collected by the cleaning device has been known.

In a constitution in which each of the intermediary transfer belt and the secondary transfer belt is provided with the cleaning blade, there is a need to appropriately supply the toner to each cleaning blade. As described in JP-A 2007-127963, in a constitution in which an image patch is formed between recording materials during execution of an image forming job for continuously forming images on the recording materials, a collection designation of this patch image may preferably be set in the following manner.

That is, the transfer residual toner is supplied to the intermediary transfer belt and therefore the toner is not excessively insufficient at the cleaning blade for cleaning the intermediary transfer belt in few cases but the transfer residual toner does not reach the cleaning blade for cleaning the secondary transfer belt. For that reason, the toner is insufficient at the cleaning blade for cleaning the secondary transfer belt.

Therefore, the above-described problem can be solved by transferring the patch image between the recording materials onto the secondary transfer belt and then by removing the patch image with the cleaning blade.

However, the patch image is increased in toner amount (per unit area) and when a frequency in formation of the patch image between the recording materials becomes high, the amount of the toner accumulated in the neighborhood of an edge of the cleaning blade for cleaning the secondary transfer belt is excessively increased. Thus, there arises a problem that a cleaning performance is lowered.

SUMMARY OF THE INVENTION

A principal object of the present invention is to provide an image forming apparatus capable of suppressing a cleaning performance of a cleaning blade for cleaning a secondary transfer belt.

According to an aspect of the present invention, there is provided an image forming apparatus comprising:

an image bearing member;

image forming means for forming a toner image on the image bearing member;

a first cleaning member for cleaning the image bearing member;

a transfer belt for carrying a recording material;

a second cleaning member for cleaning the transfer belt;

transfer means for transferring the toner image from the image bearing member onto the recording material carried on the transfer belt;

a controller for controlling said image forming means so that a detection toner image is, when a job for continuously forming the toner image on sheets of the recording material is executed, formed in an interval between images to be formed on a sheet and a subsequent sheet;

a detecting member for detecting the detection toner image;

adjusting means for adjusting an image forming condition depending on an output of the detecting member; and voltage control means for controlling a voltage to be applied to the transfer means in the intervals in the job so that a number of cleaning operations of the second cleaning member by transferring the detection toner image from the image bearing member onto the transfer belt under application, to said transfer means, of a voltage of an opposite polarity to a normal charge polarity of the toner and then by removing the detection toner image with the second cleaning member is higher than a number of cleaning operations of the first cleaning member by leaving the detection toner image formed on the image bearing member on the image bearing member under application, to the transfer means, of a voltage of the same polarity as the normal charge polarity of the toner and then by removing the detection toner image with the first cleaning member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 6 includes tables showing experimental result data regarding a relationship between a patch toner collecting frequency and an occurrence of improper cleaning with respect to cleaning devices for an intermediary transfer belt and a (secondary) transfer belt.

FIGS. 9A, 9B and 9C are schematic views for illustrating a problem.

DESCRIPTION OF THE PREFERRED EMBODIMENTS

Embodiment 1

(1) Structure of Image Forming Apparatus

Figure 1:
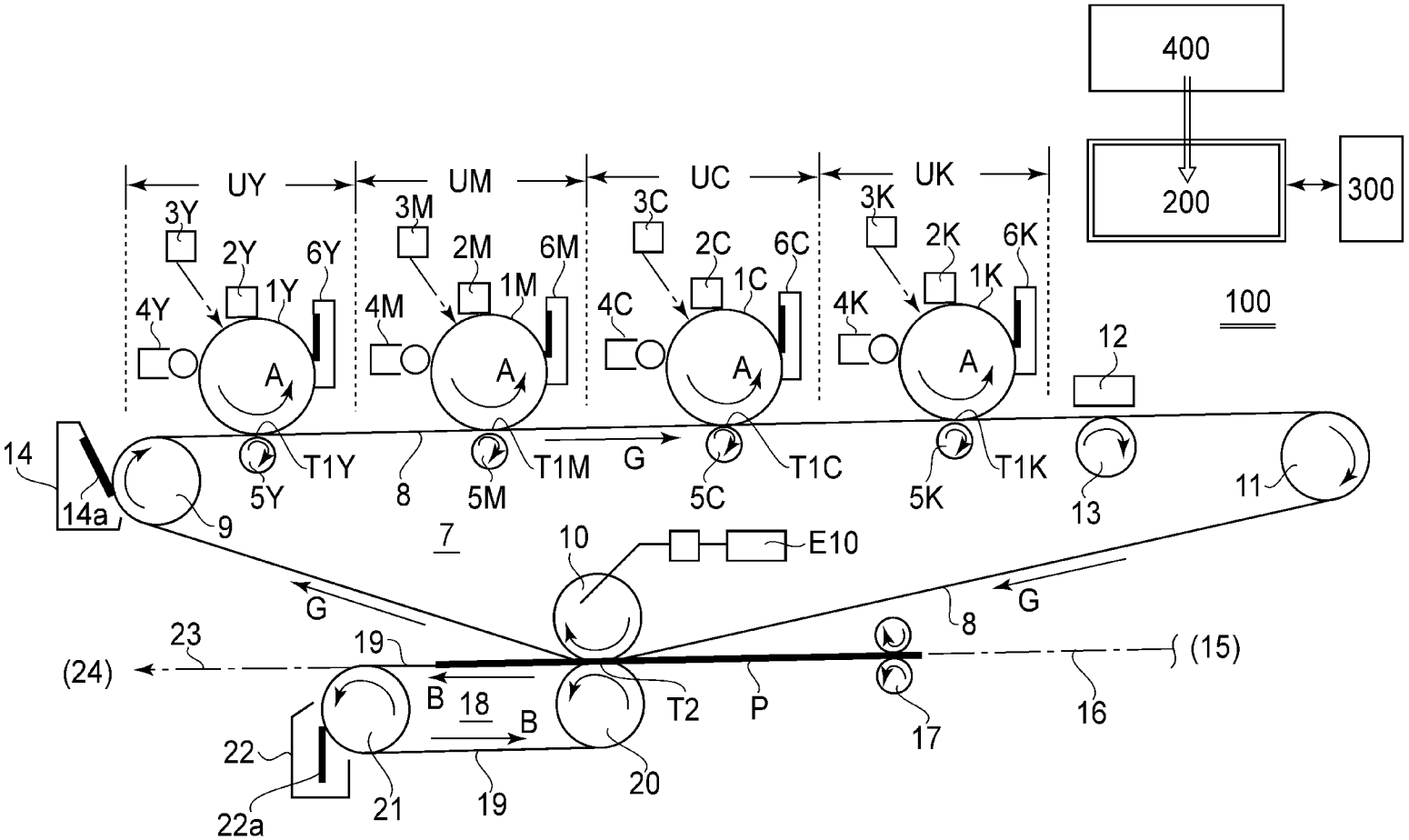
FIG. 1 is a schematic structural view of an image forming apparatus in Embodiment 1.
Figure 2:
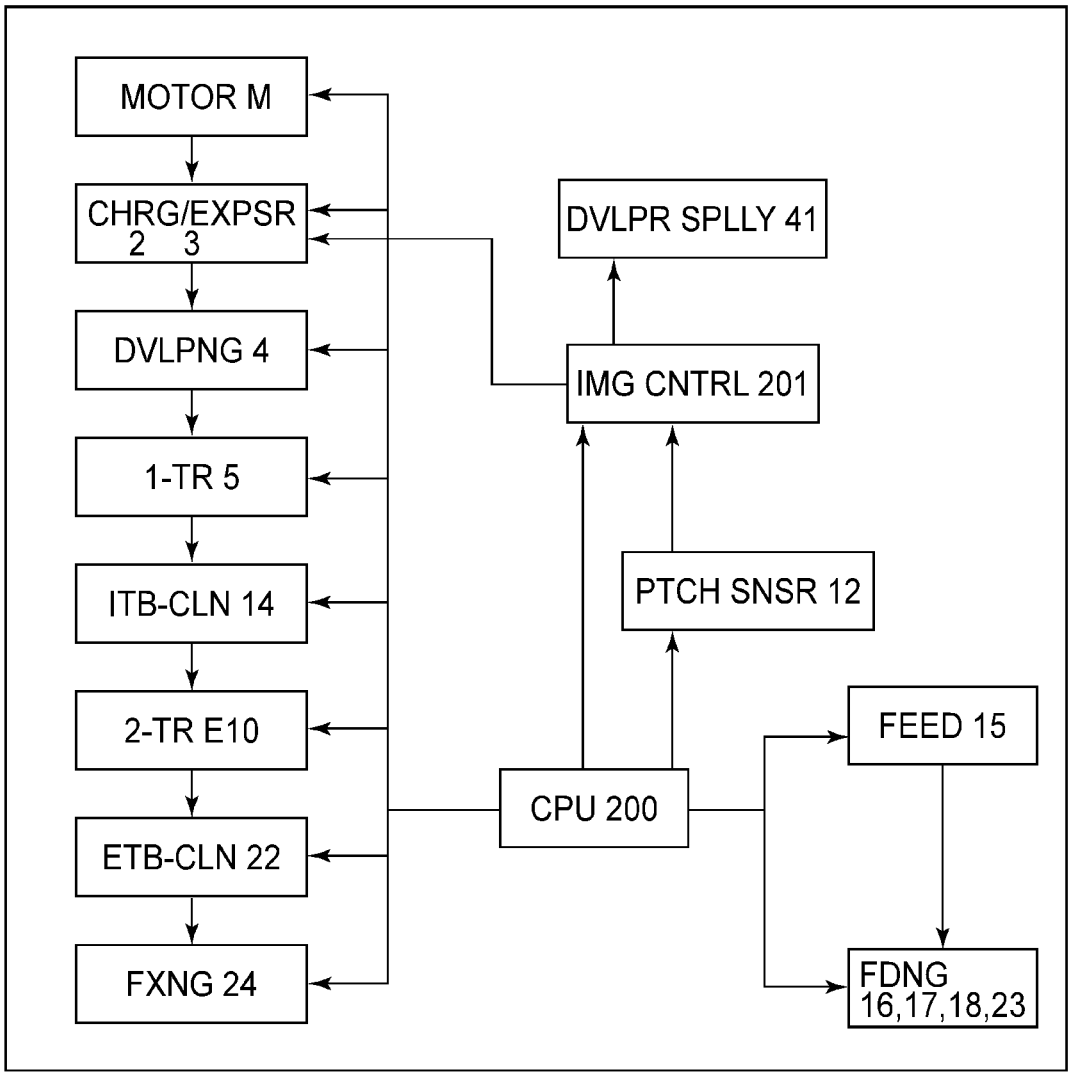
FIG. 2 is a block diagram of a control system.

FIG. 1 is a schematic structural view of an image forming apparatus 100 in this embodiment. FIG. 2 is a block diagram of a control system of the apparatus 100. The apparatus 100 is a four color-based full-color electrophotographic image forming apparatus of a tandem type in which four image forming portions are juxtaposed. That is, a color image can be formed on a recording material P on the basis of electrical image information (image signal) inputted from a host device 400 into a control circuit portion (control means) 200. The host device 400 is an image reading device (image reader), a personal computer (PC), a terminal on the network, a remote facsimile machine, a word processor or the like and is connected to the control circuit portion 200 via an interface portion. The recording material P is a recording medium capable of forming a toner image and is a sheet-like member such as a sheet, an OHP sheet, a label or a cloth. The control circuit portion 200 includes CPU (computing portion) and effects transfer f various pieces of electrical information between itself and the host device 400 or an operating portion 300 including a display portion. Further, the control circuit portion 200 monitors and controls operations of various devices in the apparatus 100, thus controlling a print operation (image forming operation) of the apparatus 100 in a centralized manner in accordance with a predetermined control program or a predetermined reference table.

In the apparatus 100, from a left side to a right side in FIG. 1, first to fourth (four) image forming portions U (UY, UM, UC, UK) are juxtaposed in the horizontal direction (tandem type). The respective image forming portions U are electrophotographic image forming mechanisms which are merely different in colors of developers (hereinafter referred to as toners) accommodated in developing devices and have the same constitution. The image forming portions U in this embodiment include rotatable drum-type electrophotographic photosensitive members 1 (1Y, 1M, 1C, 1K), respectively, for forming an electrostatic latent image. Each electrophotographic photosensitive member (hereinafter referred to as a drum) 1 is rotationally driven in the counterclockwise direction indicated by an arrow A at a predetermined speed by a driving means (main motor M in FIG. 2) of the apparatus 100. Each image forming portion further includes, as process means acting on the drum 1, a charging device 2 (2Y, 2M, 2C, 2K), an image exposure device 3 (3Y, 3M, 3C, 3K), a developing device 4 (4Y, 4M<4C, 4K), a primary transfer device 5 (5Y, 5M, 5C, 5K) and a cleaning device 6 (6Y, 6M, 6C, 6K).

The charging device 2 is a charging means for uniformly charging a surface of the drum 1 to a predetermined polarity and potential. The image exposure device 3 is an image exposure means for scanning-exposing the surface of the drum 1 to light which is modulated depending on the image information, and is, e.g., a laser scanner unit. By this charging and exposure, an electrostatic latent image depending on the image information is formed on the surface of the drum 1. The charging means 2 and the image exposure means 3 constitute an electrostatic latent image forming means for forming the electrostatic latent image on the drum 1. The developing device 4 is a developing means for visualizing the electrostatic latent image formed on the surface of the drum 1 as a toner image (developer image). A reverse development type in which the toner is deposited on an exposed portion of the electrostatic latent image is employed. In the developing device 4Y of the first image forming portion UY, the toner of yellow (Y) is accommodated. In the developing device 4M of the second image forming portion UM, the toner of magenta (M) is accommodated. In the developing device 4C of the third image forming portion UC, the toner of cyan (C) is accommodated. In the developing device 4K of the fourth image forming portion UK, the toner of black (K) is accommodated. The cleaning device 6 is a cleaning means for removing primary transfer residual toner from the surface of the drum 1.

Under the image forming portions U (UY, UM, UC, UK), an intermediary transfer belt unit 7 is provided. The unit 7 includes a flexible endless belt (ITB) 8 as an intermediary transfer member which is a rotatable image bearing member. Each image forming portion U (UY, UM, UC, UK) is an image forming means for forming the toner image on the belt 8. The belt 8 is stretched around a driving roller 9, an opposite roller 10 for secondary transfer and a tension roller 11 which are used as a plurality of stretching rollers. The belt 8 is rotationally driven by the roller 9 in the clockwise direction indicated by arrows G at the same peripheral speed as that of the drum 1. The primary transfer device 5 of each image forming portion U is a transfer roller (electroconductive charging roller) in this embodiment and is provided inside the belt 8. Further, each transfer roller 5 is press-contacted to an upper-side belt portion between the rollers 9 and 11 toward a lower surface of an associated drum 1. A contact portion (nip) between each drum 1 and the belt 8 is a primary transfer portion T1 (T1Y, T1M, T1C, T1K).

With respect to the belt rotational direction, at a belt surface side of a belt portion located downstream of the fourth image forming portion UK and upstream of the tension roller 11, a patch image detecting sensor (patch image detecting means) 12 is provided opposed to the belt surface with a predetermined gap. The sensor (detecting member) 12 detects (photoelectrically reads) a density of a toner patch image (detection toner image) for system control. This sensor 12 will be described later. At a belt back surface side corresponding to a position of the sensor 12, a belt back-up roller 13 for supporting the belt 8 from the back surface side is provided. This roller 13 is disposed to stably keep a gap distance between the sensor 12 and the belt surface.

Further, a cleaning device 14 for cleaning the belt surface after the secondary transfer is provided opposed to a belt winding portion of the driving roller 9. The cleaning device 14 is a blade cleaning device and uses an elastic cleaning blade (plate-like elastic member: first cleaning member) 14*a* as the cleaning member. A free edge portion of the blade 14*a* is contacted to the belt surface counter-directionally with the belt rotational direction. A residual deposited matter on the belt surface after the secondary transfer is removed (scraped) from the belt surface by sliding between the blade 14*a* and the belt 8, so that the surface of the belt 8 is cleaned.

Under the unit 7, a secondary transfer unit 18 is provided. The unit 18 includes an endless transfer belt (transfer belt for carrying the recording material: ETB) 19 as a rotatable secondary transfer member for forming a secondary transfer portion T2 where the recording material P is applied to the belt 8. The belt 19 is stretched around a secondary transfer roller (transfer means for transferring the toner image formed on the belt 8 onto the recording material carried on the belt 19) 20 and a tension roller 21 which are used as a plurality of stretching rollers. The roller 20 is press-contacted to the belt 19 toward the belt 8 and the lower surface of the roller 10 with a predetermined pressing force. A contact portion (nip) between the belts 19 and 8 is the secondary transfer portion T2. Incidentally, the secondary transfer portion T2 may also be a non-contact portion where the belts 8 and 19 are opposed to each other with a slight gap therebetween. The belt 19 is rotationally driven in the counterclockwise direction indicated by arrows B at the same speed as that of the belt 8 by using the roller 20 as a driving roller. The roller 21 is located downstream of the roller 20 with respected to a recording material conveyance direction. Further, a cleaning device 22 for cleaning the surface of the belt 19 is provided opposed to a belt winding portion of the roller 21. The cleaning device 22 is a blade cleaning device and uses an elastic cleaning blade (plate-like elastic member: second cleaning member) 22*a* as the cleaning member. A free edge portion of the blade 22*a* is contacted to the belt surface counter-directionally with the belt rotational direction. A residual deposited matter on the belt surface is removed (scraped) from the belt surface by sliding belt the blade 22*a* and the belt 19, so that the surface of the belt 19 is cleaned.

An operation for forming a full-color image is as follows. The drum 1 of each image forming portion U is rotationally driven. The belts 8 and 19 are also rotationally driven. The unit 3 is also driven. In synchronism with these drives, at each image forming portion U, the charging device 2 uniformly charges the surface of the drum 1 to the predetermined polarity and potential with predetermined control timing. The unit 3 scanning-exposes the surface of the drum 1 with laser light which is modulated depending on the image information of an associated color. As a result, the electrostatic latent image depending on the image information of the associated color is formed on the surface of the drum 1 with predetermined control timing. Then, the electrostatic latent image is developed as the toner image by the developing device 4.

By the electrophotographic image form process operation as described above, a Y (yellow) toner image corresponding to a Y component of the full-color image is formed on the drum 1Y of the first image forming portion UY. Then the toner image is primary-transferred onto the belt 8 at the primary transfer portion T1Y. An M (magenta) toner image corresponding to an M component of the full-color image is formed on the drum 1M of the second image forming portion UM. The toner image is primary-transferred superposedly onto the Y toner image, at the primary transfer portion T1M, which has already been transferred onto the belt 8. A C (cyan) toner image corresponding to a C component of the full-color image is formed on the drum 1C of the third image forming portion UC and then, at the primary transfer portion T1C, is primary-transferred superposedly onto the Y and M toner images which have already been transferred onto the belt 8. A K (black) toner image corresponding to a K component of the full-color image is formed on the drum 1K of the fourth image forming portion UK. Then, the toner image is primary-transferred superposedly onto the Y, M and C toner images, at the primary transfer portion T1K, which have already been transferred onto the belt 8.

At each image forming portion U, the primary transfer from the drum 1 onto the belt 8 is performed by applying a primary transfer voltage to the roller 5. That is, to the roller 5, a primary transfer voltage of a predetermined potential and an opposite polarity (positive) to the normal charge polarity (negative in this embodiment) of the toner is applied from a primary transfer voltage applying means (power source portion: not shown). The primary transfer is performed by an electric field by this applied voltage and nip pressure at the primary transfer portion T1. Thus, a full-color unfixed toner image based on the four colors of Y (yellow), M (magenta), C (cyan) and K (black) is synthetically formed on the belt 8. At each image forming portion U, the toner remaining on the drum 1 surface after the primary transfer of the toner image onto the belt 8 is removed by the cleaning device 6.

On the other hand, the recording material P is fed from a sheet feeding portion 15 (not shown specifically) side with predetermined control timing and is conveyed to a registration roller 17 along a conveying path 16. The recording material P is subjected to registration adjustment by the roller 17 and thereafter is synchronized with an image portion of the belt 8 to be conveyed to the secondary transfer portion T2. The recording material P conveyed to the secondary transfer portion T2 by the rotation of the belt 8 and the belt 19 is nip-conveyed in the nip of the secondary transfer portion T2. At that time, to the opposite roller 10 for the secondary transfer, a secondary transfer voltage (forward bias) which is constant current-controlled and of the same polarity (negative) as the normal charge polarity (negative) of the toner is applied from a secondary transfer voltage applying means E10 controlled by the control circuit portion 200. For example, the current of −30 μA to −40 μA is passed. As a result, in a process in which the recording material P is nip-conveyed at the secondary transfer portion T2, the toner images of the image portion of the belt 8 are secondary-transferred successively onto the recording material P by the electric field and the nip pressure at the secondary transfer portion T2.

The secondary transfer voltage applying means E2 is a power source portion capable of applying a reverse bias of an opposite polarity to that of the forward bias which generates the electric field in a direction in which the toner images primary-transferred onto the belt 8 are transferred onto the belt 19 side at the secondary transfer portion T2. This bias switching is effected by the control circuit portion (voltage control means) 200. This will be described later.

The recording material P coming out of the secondary transfer portion T2 is held on the surface of the belt 19 and is separated from the belt 8, and then is conveyed to a belt winding portion of the roller 21 by further rotation of the belt 19. Then, the recording material P is separated from the surface of the belt 19 by a separating means (not shown) such as a separation claw and is passed through a conveying path 23 to be guided into a fixing device 24 (not shown specifically). The recording material P is, after the unfixed-state toner image is fixed as a fixed image on the recording material P by the fixing device 24, discharged onto a discharge tray (not shown) as an image-formed product.

On the other hand, the toner remaining on the image forming portion of the belt 8 after the secondary transfer of the toner image onto the recording material P at the secondary transfer portion T2 is removed by the cleaning device 14. That is, the cleaning of the belt 8 is effected by the cleaning device 14. Further, the deposited toner on the belt 19 after the separation of the recording material is removed by a cleaning device 22. That is, the cleaning of the belt 19 is effected by the cleaning device 22.

In the above, as the primary transfer roller 5, an electroconductive roller which was prepared concentrically integral with a metal core by forming an elastic layer of ion conductive foamed rubber (NBR) on an outer peripheral surface of the metal core in a roller-shape having an outer diameter of 16-20 mm was used. This roller 5 has a resistance value of $1\times10^5$-$1\times10^8\Omega$ measured in a normal temperature/normal humidity (N/N: 23° C./50% RH) environment and under application of a voltage of 2 KV.

As the belt 8, the following elastic belt (belt having an elastic layer) is used. That is, the elastic belt prepared by incorporating carbon black as an antistatic agent in an appropriate amount into resin materials such as polyimide and polycarbonate or various rubbers or the like so as to have a volume resistivity of $1\times10^9$–$1\times10^{14}$ Ω·cm and a thickness of 0.07-0.1 mm is used. The elastic belt having the Wallace hardness of 55-100 degrees and a coefficient of static friction at the outer peripheral surface of 0.2-0.6 was used.

As the opposite roller 10 for the secondary transfer, an electroconductive roller which was prepared concentrically integral with a metal core by forming an elastic layer of an electroconductive rubber (EPDM) on an outer peripheral surface of the metal core in a roller-shape having an outer diameter of 20 mm and a resistance value of $1\times10^5$-$1\times10^8\Omega$ measured in the N/N (23° C./50% RH) environment and under application of a voltage of 50 V was used.

The cleaning blade 14*a* used in the cleaning device 14 was formed of a polyurethane material and was contacted to the belt 8 at a linear pressure of 23-50 gf/cm.

As the belt 19, the following elastic belt (belt having an elastic layer) is used. That is, the elastic belt prepared by incorporating carbon black as an antistatic agent in an appropriate amount into resin materials, such as polyimide and polycarbonate or various rubbers or the like so as to have a volume resistivity of $1\times10^9$-$1\times10^{13}$ Ω·cm and a thickness of 0.07-0.1 mm is used. The elastic belt having the Wallace hardness of 55-100 degrees and a coefficient of static friction at the outer peripheral surface of 0.2-0.6 was used.

As the secondary transfer roller 20, a transfer roller which was prepared concentrically integral with a metal core by forming an elastic layer of ion-conductive foamed rubber (NBR) on an outer peripheral surface of the metal core in a roller-shape having an outer diameter of 24 mm and a resistance value of $1\times10^5$-$5\times10^8\Omega$ measured in the N/N (23° C./50% RH) environment and under application of a voltage of 2 kV was used.

Further, the cleaning blade 22*a* used in the cleaning device 22 was formed of a polyurethane material and was contacted to the belt 19 at a linear pressure of 23-50 gf/cm.

(2) Formation of Developer Image for System Control and System Control

Into each developing device 4, the toner (developer) is supplied timely in an appropriate amount from an associated developer supplying portion 41 (FIG. 2), so that toner content in the developing device 4 is kept within a predetermined tolerable range. In this embodiment, the control circuit portion 200 forms an image density correction patch image (developer image for system control) on a non-image portion (sheet interval) in order to judge an amount of the toner to be supplied to each developing device 4. Further, the control circuit portion 200 forms a gradation (level) correction patch image (developer image for system control) for ensuring a gradation property of image data on the non-image portion (sheet interval) in order to judge correction amounts for the charging and the exposure. Further, the densities of these patch images are detected by photoelectric reading in a process in which the patch images pass through the position of a patch image detecting sensor (patch image detecting means) 12 by the rotation of the belt 8. Electrical detect information regarding the detected patch image densities is inputted into the control circuit portion 200. An image control function portion 201 (FIG. 2) of the control circuit portion 200 controls the developer supplying portion 41 by computing the amount of the toner supplied to each developing device 4 on the basis of the inputted information. Further, by computing the correction amounts for the charging and the exposure, a charging condition of the charging device 2 and an exposure amount of the exposure device 3 during the image formation are controlled. As a result, supply accuracy of the developer and correction accuracy of the charging condition and exposure amount for halftone correction are ensured.

The control circuit portion (controller) 200 controls, when a job (continuous image forming mode) for continuously forming the toner image on the recording material is executed, the image forming portions U (UY, UM, UC, UK) so that a detection toner image is formed on the belt 8 in a sheet interval between images to be formed on the recording material. Then, depending on an output of the sensor 12, an image forming condition is adjusted.

Figure 3:
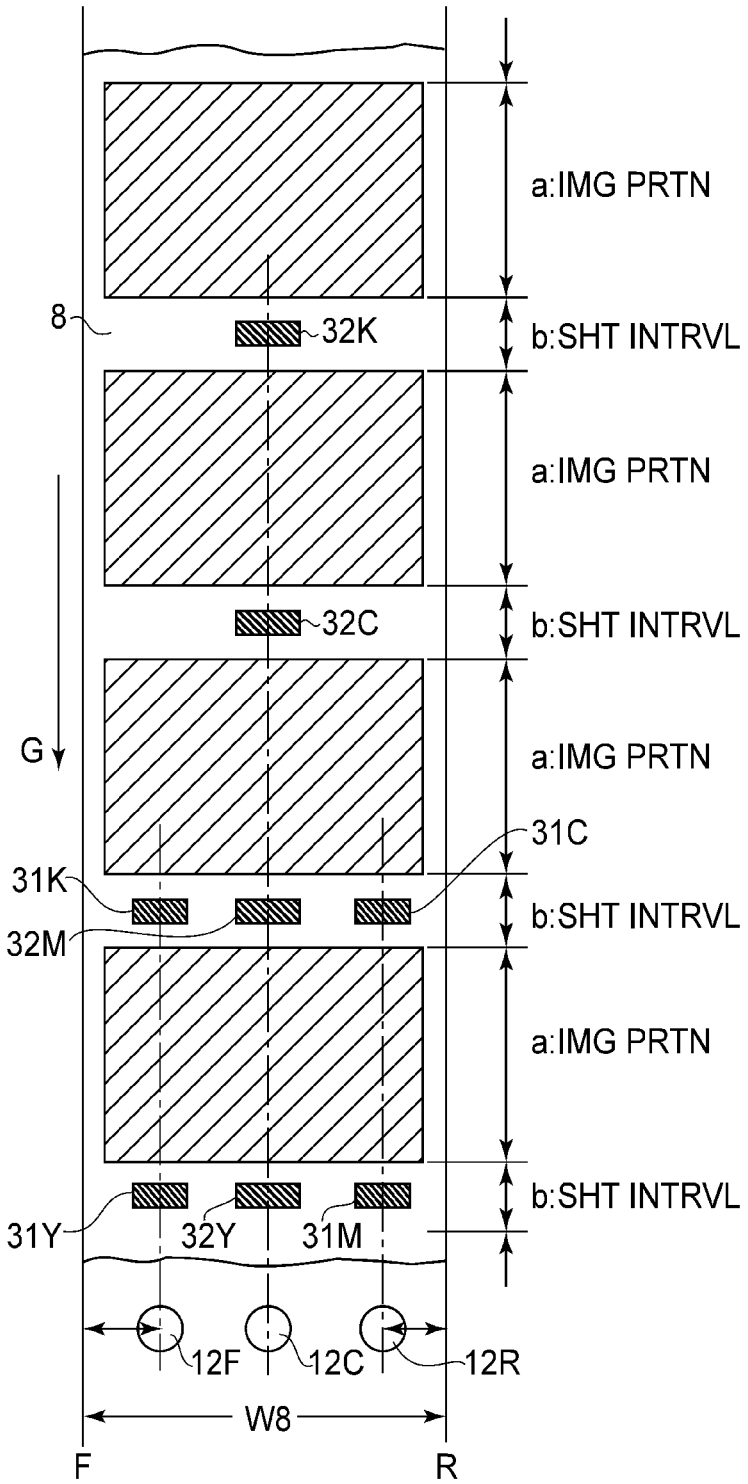
FIG. 3 is a belt development for illustrating image portions and developer images for system control which are formed on an intermediary transfer belt and for illustrating a patch image detecting means.

The above control in this embodiment will be described more specifically. FIG. 3 is a development of the belt 8 for illustrating the image portions and developer images for system control formed on the belt 8 and the patch detecting means in the continuous image forming mode. In this embodiment, a widthwise dimension W8 of the belt 8 (a dimension of the belt 8 with respect to a direction (main scan direction) perpendicular to the rotational direction (sub-scan direction) G) is about 350 mm. Individual image formation on the surface of the rotating belt 8 in the continuous image forming mode is effected along the rotational direction (sub-scan direction) G of the belt 8 in predetermined sheet intervals.

The sheet interval is an interval portion between a trailing end of a recording material P and a leading end of a subsequent recording material P and is the non-image portion on the belt 8. The sheet interval constitutes a non-sheet-passing portion at the secondary transfer portion T2. In the case of the image formation on only one sheet, belt portions before and after the image forming portion formed on the belt 8 is the non-image portion and constitutes the non-sheet-passing portion at the secondary transfer portion T2.

In FIG. 3, a reference symbol a represents the image portion and a reference symbol b represents the sheet interval. The sheet interval b is the non-image portion. In FIG. 3, the image portion a corresponds to A4 size. The sheet interval b is set at 70-80 mm with respect to the sub-scan direction G.

The patch image developing sensor 12 includes 3 sensors in total, with respect to the belt widthwise direction, a central sensor 12C at a central portion, one end-side sensor 12F at one end-side position and the other end-side sensor 12R at the other end-side portion. The one end-side sensor 12F is disposed at the position which is about 70 mm inside and from one belt widthwise end F of the belt 8 while opposing the belt 8. The other one end-side sensor 12R is disposed at the position which is about 70 mm inside and from the other belt widthwise end R of the belt 8 while opposing the belt 8. The central sensor 12C is disposed at the belt widthwise center position while opposing the belt 8.

Gradation (level) correction patch images 31 (31Y, 31M, 31C, 31K) (hereinafter referred to as gradation patches) are formed in sheet interval areas of the belt 8. That is, the gradation patches are patch images formed by the first to fourth image forming portions U (UY, UM, UC, UK) in the sheet intervals and the positions corresponding to the one end-side sensor 12F and the other end-side sensor 12R. The one end-side sensor 12F alternately detects, every sheet interval, the density of the gradation patch 31Y with Y toner formed on the belt 8 at the image forming portion UY and the density of the gradation patch 31K with K toner formed on the belt 8 at the image forming portion UK in a process in which each patch passes through the sensor position. The other end-side sensor 12R alternately detects, every sheet interval, the density of the gradation patch 31M with M toner formed on the belt 8 at the image forming portion UM and the density of the gradation patch 31C with C toner formed on the belt 8 at the image forming portion UC in a process in which each patch passes through the sensor position.

Image density correction patches 32 (32Y, 32M, 32C, 32K) (hereinafter referred to as density patches) are formed in the sheet interval areas of the belt 8 at the positions corresponding to the central sensor 12C by the first to fourth image forming portions U (UY, UM, UC, UK). The density patch 32Y is a patch formed with Y toner at the image forming portion UY, and the density patch 32M is a patch formed with M toner at the image forming portion UK. The density patch 32C is a patch formed with C toner at the image forming portion UC, and the density patch 32K is a patch formed with K toner at the image forming portion UK. In this embodiment, these density patches 32 are formed, every sheet interval, in the order of the color patches 32Y, 32M, 32C and 32K. The central sensor 12C detects each of the density patches in that order by the photoelectric reading in the process in which each patch passes through the sensor position. A size of each of the respective gradation patches 31 and the respective density patches 32 is about 40 to about 60 mm in main scan direction and is about 20 to about 30 mm in sub-scan direction.

Electrical detection information regarding the patch image densities which are photoelectrically read by the above-described sensors 12L, 12C and 12R are inputted into the control circuit portion 200. The control circuit portion controls, depending on a detection result for each of the gradation patches 31, the charging condition or the exposure amount at a corresponding image forming portion U. Further, depending on a detection result for each of the density patches 32, the control circuit portion controls the developer supply amount at a corresponding image forming portion U.

(3) Dividing Control of Patch Toner into Cleaning Devices 14 and 22

Figure 4:
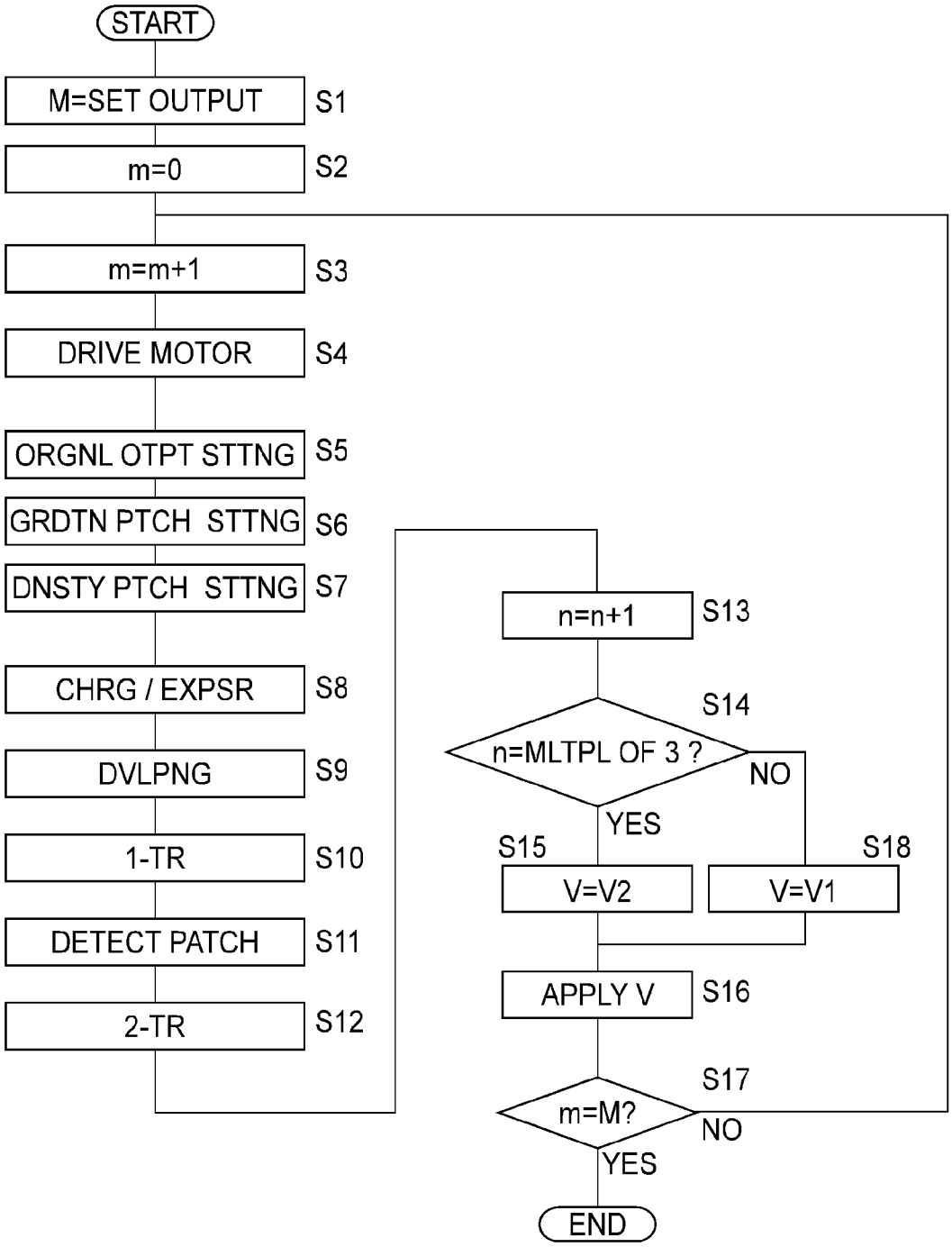
FIG. 4 is a control flowchart.

FIG. 4 is a flowchart of dividing control of the patch toner into the cleaning devices 14 and 22 effected by the control circuit portion 200. The patch toner refers to the developers of the developer images for system control, such as the density patches and the gradation patches, formed on the non image portions of the belt 8. An execution body of the flowchart is CPU of the control circuit portion 200 as the control means, and the CPU controls the respective portions on the basis of programs stored in ROM. The CPU functions as an order determining means by the programs. The control circuit portion 200 effects, when receives an image formation start signal, drive of the main motor M and settings of an original image output, the gradation patch images and the density patch images (Steps S1 to S7). Then, the electrostatic latent image is formed on the drum 1 by the charging device 2 and the exposure device 3 (S8) and is developed with the toner by the developing device 4, so that the toner image is formed on the drum 1 (S9). Then, the original image and the patch images (of the gradation patches and the density patches are primary transferred onto the belt 8 by applying the bias of the opposite polarity to the toner charge polarity, to the primary transfer means 5 (S10). Then, the densities of the patch images on the belt 8 are detected by the sensors 12 (12L, 12C, 12R) (S11). The original image (image portion) formed on the belt 8 is successively secondary transferred, at the secondary transfer portion T2, onto the recording material P conveyed to the secondary transfer portion T2 at the predetermined control timing by the registration roller 17 (S12). This secondary transfer is performed by applying, to the opposite roller 10 for the secondary transfer, the forward bias (transfer voltage for the image portion) of the predetermined potential and the same polarity (negative) as the normal charge polarity (negative) of the toner from the secondary transfer voltage applying means E10 controlled by the control circuit portion 200.

Figure 5A:
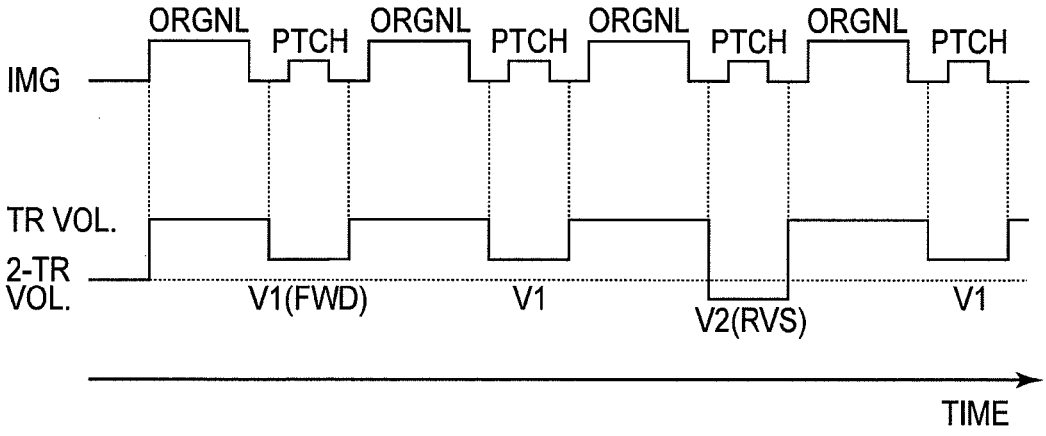
FIG. 5A is a time chart of sheet interval voltage control.

On the other hand, the toner of the patch images formed in the sheet interval areas of the belt 8 is, as shown in FIG. 4 and FIG. 5A, dividedly collected by the cleaning device 14 for the belt 8 and the cleaning device 22 for the belt 19 by the control of a sheet interval voltage V described below. The sheet interval voltage V is a voltage to be applied from the secondary transfer voltage applying means E10 to the roller 10 during the passing of the sheet interval area of the belt 8 through the secondary transfer portion T2.

That is, the control circuit portion 200 includes an image counter (count: n). In this embodiment, when n is not a multiple of 3, the sheet interval voltage V is changed to a forward bias V1 (S13, S14, S18). This forward bias V1 is of the same polarity (negative) as the normal charge polarity (negative) of the toner. In this embodiment, a current passing through the secondary transfer portion T2 by the application of the forward bias V1 (S16) is controlled at −15 μA to −20 μA. As a result, the toners of the gradation patches 31 and the density patches 32 in the sheet intervals of the belt 8 are successively transferred from the belt 8 side onto the belt 19 side in the process in which the toners pass through the secondary transfer portion T2. The transferred toners reach the cleaning device 22 by further rotation of the belt 19 and are removed from the belt 19, thus being collected.

On the other hand, when n is a multiple of 3, the sheet interval voltage V is changed to a reverse bias V2 (S13, S14, S15). This reverse bias V2 is of the opposite polarity (positive) to the normal charge polarity (negative) of the toner. In this embodiment, a current passing through the secondary transfer portion T2 by the application of the forward bias V2 (S16) is controlled at +3 μA to +7 μA. As a result, the toners of the gradation patches 31 and the density patches 32 in the sheet intervals of the belt 8 are not transferred from the belt 8 side onto the belt 19 side in the process in which the toners pass through the secondary transfer portion T2. The transferred toners reach the cleaning device 14 by further rotation of the belt 8 while being carried on the belt 8 and are removed from the belt 14, thus being collected.

That is, in this embodiment, as shown in FIG. 5A, the dividing control is effected in a manner that when the patch toner is collected two times by the cleaning device 22 for the belt 19, the patch toner is collected one time by the cleaning device 14 for the belt 8. Then, until an output sheet number m reaches a set output sheet number M (S17), the patch toner is dividedly collected by the cleaning device 14 and the cleaning device 22 at the above-described frequency (dividing ratio). The count n of the image counter is used as it is when subsequent image formation is started. However, when the count n reaches a multiple of 3, the count n of the image counter may also be cleared to zero.

Figure 5B:
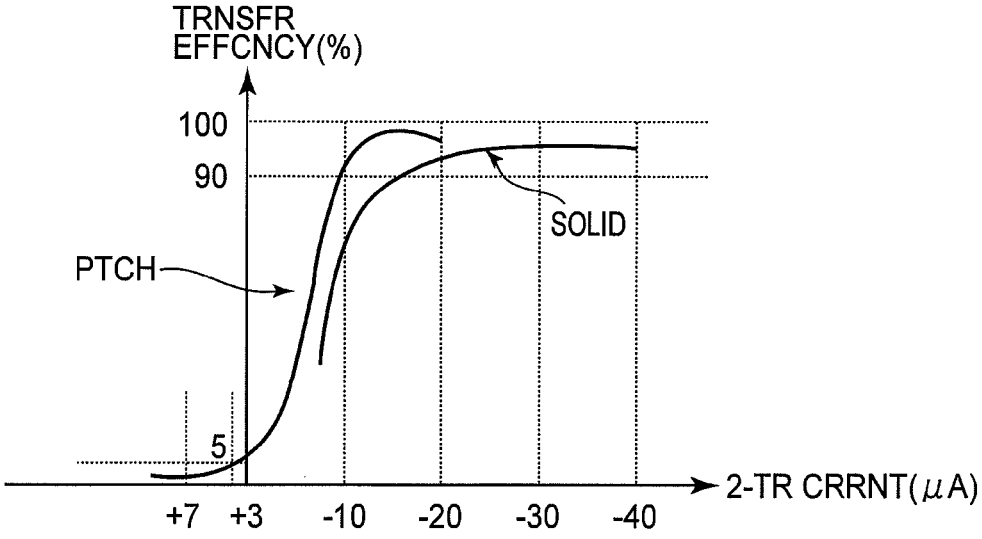
FIG. 5B is a correlation graph between secondary transfer current and transfer efficiency with respect to a solid image and a patch image.

Here, a relationship between a secondary transfer current and a transfer efficiency with respect to a solid image (image portion) and the patch image is shown in FIG. 5B. A measuring method is as follows. A patch (image) of about 40 mm to about 60 mm is main scan direction and about 20 mm to about 30 mm in sub-scan direction is formed on the belt 8. The patch is secondary-transferred onto CLC sheet (basis weight: 80 $g/m^2$, available from Canon Marketing Japan Inc.). A PET tape (mfd. by Lintec Corp.) is applied onto the transferred patch and the density at that time is measured by a densitometer (mfd. by X-Rite, Inc.). The density is taken as D1. On the other hand, the secondary transfer residual toner remaining on the belt 8 is removed by the above PET tape, and the PET tape is applied onto the CLC sheet described above and then is subjected to the measurement with the densitometer. The measured density is taken as D2. Further, only the tape (with no toner) is applied onto the CLC sheet, and the density is measured with the densitometer and is taken as D3. The transfer efficiency is calculated by: $(D1-D3)/\{(D1-D3)+(D2-D3)\}\times 100$.

1) Incidentally, as shown in FIG. 6, the patch is formed every sheet interval and is collected in the cleaning device 14 for the belt 8 while always keeping the sheet interval voltage V at the reverse bias V2 (frequency=100%). In this case, the toner amount for the blade 14*a* was excessively large (FIG. 9C), so that the toner passed through the blade 14*a* at the passing sheet number of 21-27 sheets to cause improper cleaning (improper CLN). In this case, an experiment was conducted by using a halftone original image with the density of 0.3 (measured by the densitometer mfd. by X-Rite, Inc.), the recording material of about 10 mm in sheet (paper) width in the main scan direction and about 150 mm in sheet width in the sub-scan direction, and the recording material of about 330 mm in sheet width in the main scan direction and about 483 mm in the sub-scan direction.

2) In a similar experiment, the patch is formed 3 times in 3 sheet intervals and is not formed in 1 sheet interval of 4 sheet intervals in total while always keeping the sheet interval voltage V at the reverse bias V2 and then is collected in the cleaning device 14 for the belt 8 (frequency=75%). Also in this case, the toner amount for the blade 14*a* was excessively large (FIG. 9C), so that the toner similarly passed through the blade 14*a* at the sheet passing number of 24-30 sheets to cause the improper CLN.

3) Further, when the patch was not formed in the sheet intervals (frequency=0%), the toner amount for the blade 14*a* was excessively small (FIG. 9A), and the blade 14*a* started chattering at the sheet passing number of 9-18 sheets and the toner as well passed through the blade 14*a* to cause the improper CLN.

4) Further, when the patch was formed 2 times in 2 sheet intervals and was not formed 2 times in 2 sheet intervals of 4 sheet intervals in total while always keeping the sheet interval voltage V at the reverse bias V2 and then was collected in the cleaning device 14 (frequency=50%), the improper CLN did not occur (FIG. 9B).

5) Similarly, when the patch was formed 1 time in 1 sheet interval and was not formed 3 times in 3 sheet intervals of 4 sheet intervals in total while always keeping the sheet interval voltage V at the reverse bias V2 and then is collected in the cleaning device 14 (frequency=25%), the improper CLN did not occur (FIG. 9B).

6) On the other hand, the patch is formed every sheet interval and is collected in the cleaning device 22 while always keeping the sheet interval voltage V at the forward bias V1 (frequency=100%). In this case, the toner amount for the blade 22*a* was excessively large (FIG. 9C), so that the toner passed through the blade 14*a* at the passing sheet number of 27 sheets to cause improper CLN. In this case, similarly as described above, an experiment was conducted by using a halftone original image with the density of 0.3, the recording material of about 10 mm in sheet (paper) width in the main scan direction and about 150 mm in sheet width in the sub-scan direction, and the recording material of about 330 mm in sheet width in the main scan direction and about 483 mm in the sub-scan direction.

7) In a similar experiment, the patch is formed 1 time in 1 sheet interval and is not formed in 3 sheet intervals of 4 sheet intervals in total while always keeping the sheet interval voltage V at the forward bias V1 and then is collected in the cleaning device 22 for the belt 19 (frequency=25%). In this case, the toner amount for the blade 22*a* for the belt 19 was excessively small (FIG. 9A), the blade 22*a* started chattering at the sheet passing number of 12-18 sheets and the toner as well passed through the cleaning blade 22*a* to cause the improper CLN.

8) Further, when the patch was not formed in the sheet intervals (frequency=0%), the toner amount for the cleaning blade 22*a* for the belt 19 was excessively small (FIG. 9A), and the cleaning blade 22*a* started chattering at the sheet passing number of 6-9 sheets and the toner as well passed through the blade 14*a* to cause the improper CLN.

9) Further, when the patch was formed 3 times in 3 sheet intervals and was not formed 1 time in 1 sheet interval of 4 sheet intervals in total while always keeping the sheet interval voltage V at the forward bias V1 and then was collected in the cleaning device 22 for the belt 19 (frequency=75%), the improper CLN did not occur (FIG. 9B).

10) Similarly, when the patch was formed 2 times in 2 sheet intervals and was not formed 2 times in 2 sheet intervals of 4 sheet intervals in total while always keeping the sheet interval voltage V at the forward bias V1 and then is collected in the cleaning device 22 for the belt 19 (frequency=50%), the improper CLN did not occur (FIG. 9B).

Incidentally, the reason why the areas in which the improper CLN occurs with respect to the patch (formation) frequency are different between the belt 8 and the belt 19 in FIG. 6 is that the amount of the toner which reaches the belt 8-side cleaning device 14 becomes large by the influence of the transfer residual toner generated by the secondary transfer.

In this embodiment, the cleaning blade 14 for the belt 8 collects the patch 1 time in 1 sheet interval of 3 sheet intervals and does not collect the patches in 2 sheet intervals of the 3 sheet intervals, so that the frequency is about 33%. On the other hand, the cleaning device 2 for the belt 19 collects the patches 2 times in 2 sheet intervals of 3 sheet intervals and does not collect the patch in 1 sheet interval of the 3 sheet intervals, so that the frequency is about 66%. As a result, in this embodiment, with respect to both of the cleaning devices 14 and 22, it was possible to prevent the occurrence of the improper cleaning.

Thus, the control such that the sheet interval voltage V at the secondary transfer portion T2 is switched between the forward bias V1 and the reverse bias V2 at a predetermined dividing number of operations depending on the sheet passing number or the patch formation frequency is effected. As a result, the patch toners and the fog toner are appropriately divided into those for the cleaning portions of the second image bearing member 8 and the secondary transfer member 19, so that the amount of the developer stagnated at the cleaning member contact portions of the second image bearing member 8 and the secondary transfer member 19 can be kept at a proper amount. Therefore, loads on the cleaning means 14 and 22 for the second image bearing member 8 and the secondary transfer member 19 can be optimized, so that a stable cleaning performance can be maintained with respect to both of the cleaning means 14 and 22.

In this embodiment, both of the intermediary transfer belt 8 and the secondary transfer belt 19 are the elastic belt including the elastic layer but it is also possible to employ an apparatus constitutions such that either one of the intermediary transfer belt 8 and the secondary transfer belt 19 is the elastic belt and the other belt is a resin material belt.

During a jam occurrence, the apparatus 100 is shut down due to an emergency by the control circuit portion 200. At this time, the blades 14*a* and 22*a* of the cleaning devices 14 and 22 are kept in a state in which these blades are separated from the belts 8 and 19, respectively, by a shifting mechanism (not shown). When jam clearance is made by a user and a reset switch (not shown) is turned on, the control circuit portion 200 restarts the main motor M to perform a recovery operation. At this time, the blades 14*a* and 22*a* of the cleaning devices 14 and 22 are kept in the separated state from the belts 8 and 19, respectively. At each image forming portion U, the rotation of the drum 1 and the rotations of the belts 8 and 19 are performed. Then, to the opposite roller 10 for the secondary transfer, the reverse bias is applied from the secondary transfer bias applying means E10, so that the current of +15 μA to +40 μA is passed. As a result, the patch toner left on the belt 19 passes through the cleaning device 22, without being removed, by the rotation of the belt 19 to reach the secondary transfer portion T2, where the patch toner is transferred onto the belt 8. Further, the patch toner left on the belt 8 passes through the secondary transfer portion T2 without being removed and while being held on the belt 8. Further, the bias of the same polarity as the toner charge polarity is applied to the primary transfer roller 5, so that the current of −15 μA to −40 μA is passed. The toner on the belt 8 passes through the cleaning device 14, without being removed, by the rotation of the belt 8 to be conveyed to the primary transfer portion T1, where the toner is transferred back onto the drum 1 of the image forming portion and is then collected by the cleaning device 6. That is, the toners on the belts 8 and 19 during the jam occurrence are collected by the cleaning device 6 for the drum 1 at the image forming portion U. The blades 14*a* and 22*a* kept in the separated state from the belts 8 and 19 are, after the predetermined recovery operation is ended, returned to a state in which the blades 14*a* and 22*a* are contacted to the belts 8 and 19, respectively, in a predetermined manner.

The image forming apparatus 100 in this embodiment is summarized as follows. The apparatus 100 includes the image bearing member 8, the image forming means U for forming the toner image on the image bearing member 8, the first cleaning member 14 (14*a*) for cleaning the image bearing member 8, the transfer belt 19 for carrying the recording material P, and the second cleaning member 22 (22*a*) for cleaning the transfer belt 19. Further, the apparatus 100 includes the transfer means 20 for transferring the toner image formed on the image bearing member 8 onto the recording material P carried on the transfer belt 19. Further, the apparatus 100 includes the controller 200 for controlling the image forming means U so that the detection toner image is, when the job for continuously forming the toner image on the recording material P is executed, formed on the image bearing member 8 in the sheet interval between the images for being formed on the recording material P. Further, the apparatus 100 includes the detecting member 12 for detecting the detection toner image and the adjusting means 200 for adjusting the image forming condition depending on the output of the detecting member 12. Further, the apparatus 100 includes the voltage control means 200 for controlling the voltage applied to the transfer means 20 in the sheet interval between the images. A number of cleaning operations of the seconds cleaning member 22*a* by transferring the detection toner image from the image bearing member 8 onto the transfer belt 19 under application, to the transfer means 20, the voltage of the opposite polarity to the normal charge polarity of the toner and then by removing the detection toner image with the second cleaning member 22*a* is referred to as a number A. Further, a number of cleaning operations of the first cleaning member 14*a* by leaving the detection toner image formed on the image bearing member 8 on the image bearing member 8 under application, to the transfer means 20, the voltage of the same polarity as the normal charge polarity of the toner and then by removing the detection toner image with the first cleaning member 14*a* is referred to as a number B. The voltage control means 200 controls the voltage applied to the transfer means in the sheet interval between the images so that the number A is higher than the number B.

Embodiment 2

Figure 7:
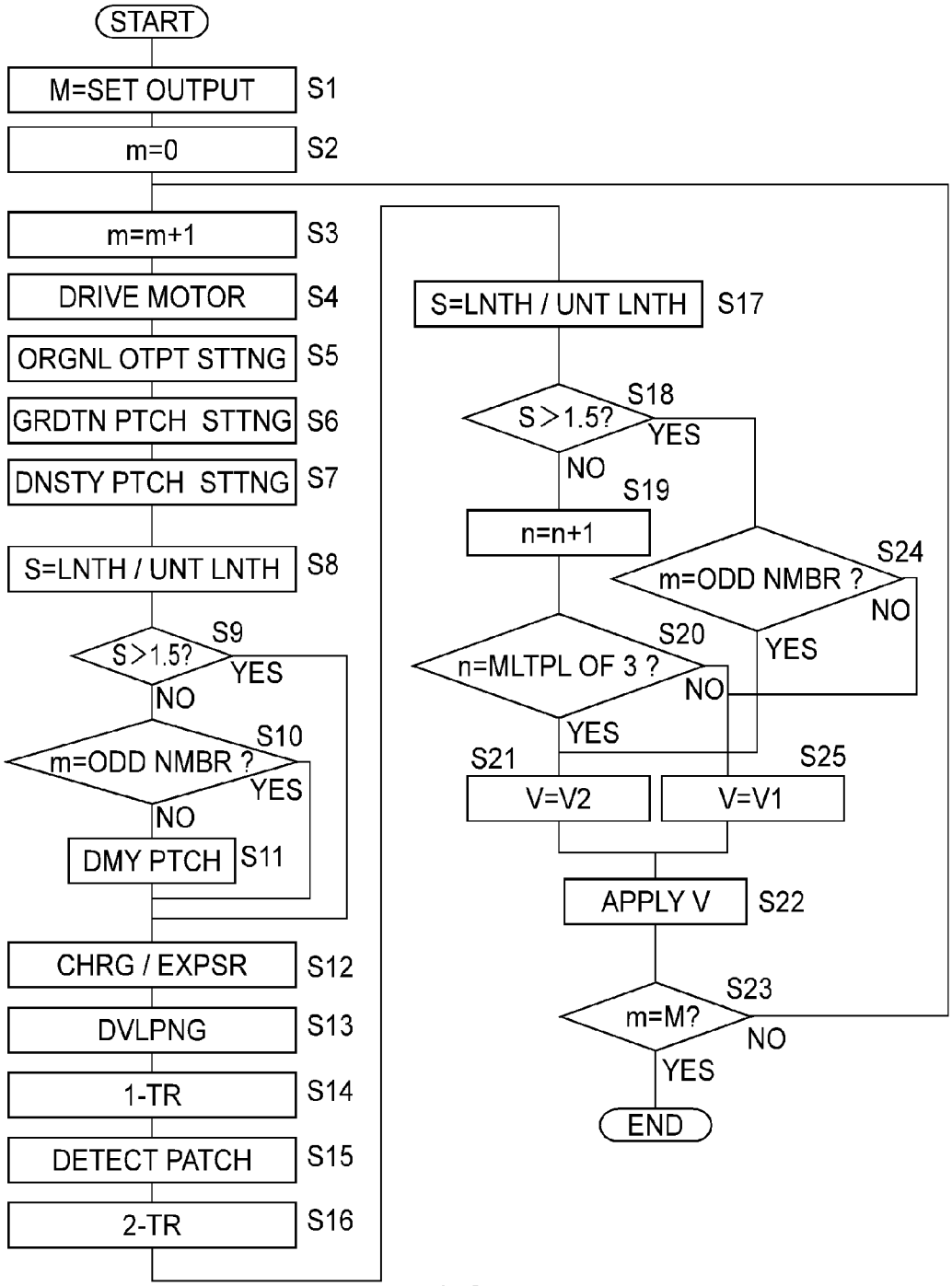
FIG. 7 is a control flowchart of an image forming apparatus in Embodiment 2.

This embodiment is characterized in that the secondary transfer voltage applying means E10 is controlled depending on the sheet interval (length) between the recording material and the subsequent recording material and the sheet passing number of the recording materials in the continuous image forming mode. FIG. 7 is a flowchart of the dividing control of the patch toner into the cleaning devices 14 and 22. Steps S1 to S7 are the same as those shown in FIG. 4 in Embodiment 1. In this embodiment, then, in the case where the sheet interval length (150 mm in this embodiment) is longer than a unit sheet interval length (75 mm in this embodiment) and a dummy patch is formable in a length of 20-30 mm with respect to the sub-scan direction and when the sheet passing number m is an even number, image forming setting for forming the dummy patch in the prolonged sheet interval is performed in steps S8 to S11. Subsequent steps S12 to S16 are the same as the steps S8 to S12 shown in FIG. 4 in Embodiment 1. The toners of the patch images formed on the belt in the sheet intervals are dividedly collected into the cleaning device 14 for the belt 8 and the cleaning device 22 for the belt 19 by effecting the sheet interval voltage as shown in FIGS. 8A through 8C (steps S17 and later).

The image forming apparatus in this embodiment forms the dummy patch of the same size as that of the normal patch in the sheet intervals under the following condition. That is, a value S obtained by dividing a certain sheet interval length (150 mm in this embodiment), which is an area in which the patch is formed, by the unit sheet interval length (75 mm in this embodiment) is larger than 1.5 (S8, S9). Further, in this case, the dummy patch is formable in the length of 20-30 mm with respect to the sub-scan direction and the sheet passing number m is the even number (S8 to S11). In the case where the sheet passing number m is an odd number (YES of S10), the dummy patch is not formed.

Figure 8A:
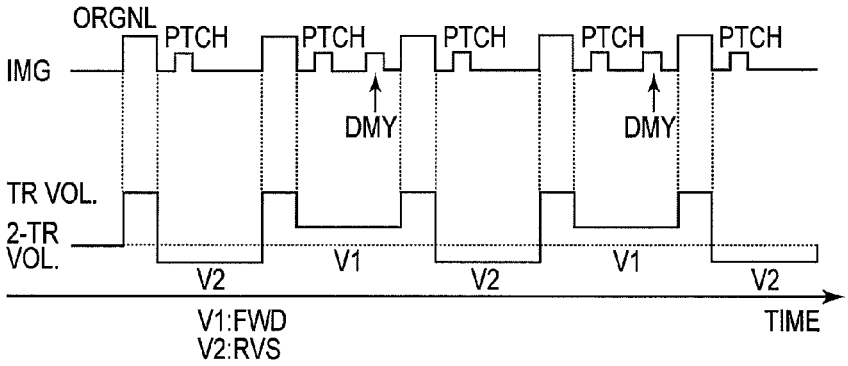
FIG. 8A is a time chart of sheet interval voltage control in Embodiment 2.
Figure 8B:
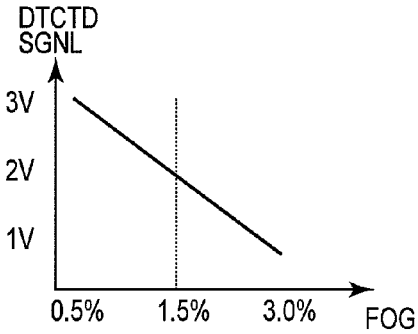
FIG. 8B is a graph showing a relationship, between a signal outputted by a sensor and fog, stored in ROM of an image forming apparatus in Embodiment 3.
Figure 8C:
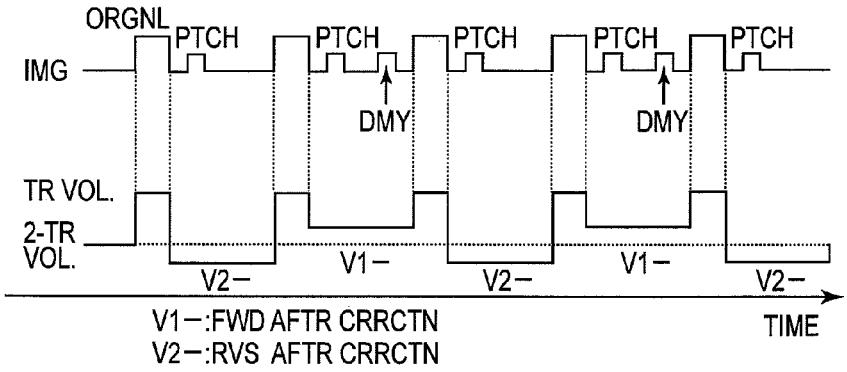
FIG. 8C is a time chart of sheet interval voltage control in Embodiment 3.

When the sheet passing number m is the odd number, as shown in FIG. 7 and FIG. 8A, the sheet interval voltage V is changed to the reverse bias V2 (S24, S21). By the reverse bias V2, the current passing through the secondary transfer portion T2 is controlled at +3 μA to +7 μA. As a result, the gradation patch and the density patch in the sheet intervals are collected by the cleaning device 14 without being transferred onto the belt 19 and while being still carried on the belt 8. When the sheet passing number m is the even number, the sheet interval V is changed to the forward bias V1 (S24, S25). By the forward bias V1, the current passing through the secondary transfer portion T2 is controlled at −15 μA to −20 μA. As a result, the gradation patch and the density patch in the sheet intervals are directly transferred onto the belt 19 and are collected by the cleaning device 22.

A result of an experiment, of the image forming apparatus in this embodiment, regarding the frequency (dividing ratio) with respect to the cleaning devices 14 and 22 is the same as that shown in FIG. 6 in Embodiment 1. In this embodiment, the dummy patch is formed as described above. Further, the cleaning device 14 for the belt 8 collects the patch 1 time in four unit sheet intervals and therefore the frequency is about 25%. On the other hand, the cleaning device 22 for the belt 19 collects the patch 2 times in the four unit sheet intervals and therefore the frequency is about 50%. Therefore, with respect to both of the cleaning devices 14 and 22, it was possible to prevent the occurrence of the improper cleaning. The operation of the apparatus during the jam occurrence is the same as that in Embodiment 1 and will be omitted from redundant description.

As described above, by controlling the frequency of the collection of the patch in the sheet interval in the cleaning means 14 for the intermediary transfer belt 8 and in the cleaning means 22 for the secondary transfer member 19 depending on the sheet interval length and the sheet passing number, a load on each of the cleaning means can be further optimized.

Embodiment 3

This embodiment is characterized in that a detecting means 12 for detecting the developer at the non-image portion of the belt 8 is provided and depending on a detection result, the secondary transfer voltage applying means E10 is controlled. Specifically, this embodiment is characterized in that the detecting means 12 for detecting the developer at the non-image portion of the second image bearing member 8 is provided and depending on a detection result, an output voltage of the secondary transfer voltage applying means E10 is controlled. Also in this embodiment, similarly as in Embodiment 2, the control for forming the dummy patch is effected. However, in this embodiment, fog on the belt 8 is detected by the patch image detecting sensor 12 and on the basis of its result, the sheet interval voltage V2 (reverse bias) and the sheet interval voltage V1 (forward bias) are collected. Specifically, as shown in FIG. 8B, a relationship between the fog and a signal outputted by the sensor 12 is stored in ROM of the control circuit portion 200 in advance, and when the fog exceeds 1.5%, the reverse bias V2 is corrected to V2 (FIG. 8 (C)). As a result, the current passing through the secondary transfer portion T2 is 0 μA to +2 μA. Further, by correcting the forward bias V1 to V1−, the current passing through the secondary transfer portion T2 is −10 μA to −15 μA. When the amount of the fog is large, the toner charge amount is lowered and therefore by lowering the sheet interval voltage V, the amount of charge injection into the toner is reduced as small as possible. Thus, the patches in the sheet intervals or the fogs are transferred onto the belts 8 and 19 as much as possible, so that the toner amount in the cleaning devices 14 and 22 is stabilized.

A result of an experiment, of the image forming apparatus in this embodiment, regarding the frequency (dividing ratio) with respect to the cleaning devices 14 and 22 is the same as that shown in FIG. 6 in Embodiment 1. In this embodiment, the dummy patch is formed as described above. This dummy patch is not reflected in the image forming condition but is used for adjusting the amount of the toner supplied to the cleaning device. This dummy patch is the toner, for adjusting the amount of the toner supplied to the cleaning device, which is formed so that its total amount per unit area is equal to that of the normal patch images. Further, similarly as in Embodiment 2, also in this embodiment, the cleaning device 14 for the belt 8 collects the patch 1 time in four unit sheet intervals and therefore the frequency is about 25%. On the other hand, the cleaning device 22 for the belt 19 collects the patch 2 times in the four unit sheet intervals and therefore the frequency is about 50%. Therefore, the supply frequency of the toner images formed between the image forming portions with respect to both of the cleaning devices 14 and 22, can be made equal to a predetermined frequency, so that it was possible to prevent the occurrence of the improper cleaning. The operation of the apparatus during the jam occurrence is the same as that in Embodiment 1 and will be omitted from redundant description.

As described above, by optimizing the sheet interval voltage applied in the sheet interval, loads on the cleaning means 14 for the intermediary transfer belt 8 and on the cleaning means 22 for the secondary transfer member 19 can be optimized and stabilized.

Other Embodiments

1) The electrophotographic photosensitive drum may also be an electrostatic recording dielectric member. In this case, the electrostatic recording dielectric member is uniformly charged and the charged surface thereof is selectively charge-removed by a discharging array or an electron gun unit, so that the electrostatic latent image is formed. Alternatively, the electric charge is selectively imparted to the surface of the electrostatic recording dielectric member by the electron gun unit, so that the electrostatic latent image is formed.

2) The image forming apparatus is not limited to the full-color or multi-color image forming apparatus but may also be a monochromatic image forming apparatus or an image forming apparatus operable in a monochromatic mode.

3) The belt 8 may also be formed in a drum shape.

4) In the image forming apparatuses in the embodiments described above, the secondary transfer voltage applying means E10 may also be connected to the secondary transfer roller 20. Thus, it is also possible to employ a constitution in which the secondary transfer voltage of the polarity for generating an electric field in a direction in which the developer image primary-transferred on the belt 8 is transferred onto the belt 19 side at the nip T2, and a voltage of the opposite polarity to that of the secondary transfer voltage are applied to the secondary transfer roller 20.

As described above, according to the present invention, even when the frequency at which the patch image formed, in the large amount per unit area, between the recording materials is increased, it is possible to suppress a lowering in cleaning performance of the cleaning blade for cleaning the secondary transfer belt.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 147530/2010 filed Jun. 29, 2010, which is hereby incorporated by reference.

What is claimed is:

1. An image forming apparatus comprising:

an image bearing member;

an image forming unit configured to form a toner image on said image bearing member;

a first cleaning blade configured to abut and clean said image bearing member;

a transfer belt configured to carry a recording material;

a second cleaning blade configured to abut and clean said transfer belt;

a transfer member configured to transfer the toner image from said image bearing member onto the recording material carried on said transfer belt at a transfer portion;

a detection toner image forming portion configured to be able to form a detection toner image on said image bearing member in an interval between images to be formed on a recording material and a subsequent recording material by said image forming unit, when a job for continuously forming the toner image on the recording material is executed;

a detecting member configured to detect the detection toner image;

an adjusting portion configured to adjust a condition of said image forming unit depending on an output of said detecting member;

a power source configured to apply a voltage to said transfer member to generate, between said image bearing member and said transfer belt, a first electric field for supplying the detection toner image as a first supply toner pattern to said first cleaning blade and a second electric field for supplying the detection toner image as a second supply toner pattern to said second cleaning blade;

an electric field switching portion configured to switch the first electric field and the second electric field from one to the other; and a control portion configured to control said electric field switching portion in the job so that a ratio of a number of second supply toner patterns to a predetermined number of intervals between images is larger than a ratio of a number of first supply toner patterns to the predetermined number of intervals between images.

2. An image forming apparatus according to claim 1, wherein the detection toner image has a unit length determined in advance with respect to a movement direction of said image bearing member, and wherein when a single interval between images is capable of including a plurality of unit lengths, said detection toner image forming portion forms the detection toner image in number not more than a maximum number of unit lengths capable of being included in the single interval between images with respect to the movement direction of said image bearing member, or said detection toner image forming portion does not form the detection toner image and said control portion counts, when the ratio is determined, the number of predetermined intervals between images as the maximum number of unit lengths capable of being included in the single interval between images.

3. An image forming apparatus according to claim 1, wherein said electric field switching portion switches the first electric field and the second electric field every interval between images.

4. An image forming apparatus according to claim 1, wherein said control portion changes the first electric field and the second electric field depending on an output of said detecting member.

5. An image forming apparatus comprising:

an image bearing member;

an image forming unit configured to form a toner image on said image bearing member;

a first cleaning blade configured to abut and clean said image bearing member;

a transfer belt configured to carry a recording material;

a second cleaning blade configured to abut and clean said transfer belt;

a transfer member configured to transfer the toner image from said image bearing member onto the recording material carried on said transfer belt at a transfer portion;

a detection toner portion configured to be able to form a detection toner image on said image bearing member in an interval between images to be formed on a recording material and a subsequent recording material by said image forming unit, when a job for continuously forming the toner image on the recording material is executed;

a detecting member configured to detect the detection toner image;

an adjusting portion configured to adjust a condition of said image forming unit depending on an output of said detecting member;

a power source configured to apply a voltage to said transfer member to generate, between said image bearing member and said transfer belt, a first electric field for supplying the detection toner image as a first supply toner pattern to said first cleaning blade and a second electric field for supplying the detection toner image as a second supply toner pattern to said second cleaning blade;

an electric field switching portion configured to switch the first electric field and the second electric field from one to the other; and a control portion configured to control said electric field switching portion in the job.

* * * * *